US011572600B2

(12) United States Patent
Cho et al.

(10) Patent No.: US 11,572,600 B2
(45) Date of Patent: Feb. 7, 2023

(54) STRUCTURAL STEEL HAVING EXCELLENT BRITTLE CRACK PROPAGATION RESISTANCE, AND MANUFACTURING METHOD THEREFOR

(71) Applicant: POSCO, Pohang-si (KR)

(72) Inventors: Jae-Young Cho, Gwangyang-si (KR); Il-Cheol Yi, Gwangyang-si (KR); Sang-Deok Kang, Gwangyang-si (KR)

(73) Assignee: POSCO CO., LTD, Pohang-si (KR)

( * ) Notice: Subject to any disclaimer, the term of this patent is extended or adjusted under 35 U.S.C. 154(b) by 227 days.

(21) Appl. No.: 16/957,457

(22) PCT Filed: Nov. 30, 2018

(86) PCT No.: PCT/KR2018/015029
§ 371 (c)(1),
(2) Date: Jun. 24, 2020

(87) PCT Pub. No.: WO2019/124809
PCT Pub. Date: Jun. 27, 2019

(65) Prior Publication Data

US 2021/0071279 A1 Mar. 11, 2021

(30) Foreign Application Priority Data

Dec. 24, 2017 (KR) ..... 10-2017-0178930

(51) Int. Cl.
*C21D 9/46* (2006.01)
*C21D 6/00* (2006.01)
(Continued)

(52) U.S. Cl.
CPC ..... *C21D 9/46* (2013.01); *C21D 6/004* (2013.01); *C21D 6/005* (2013.01); *C21D 6/008* (2013.01);
(Continued)

(58) Field of Classification Search
CPC ..... C21D 2211/001; C21D 2211/002; C21D 2211/005; C21D 2211/008; C21D 6/004;
(Continued)

(56) References Cited

U.S. PATENT DOCUMENTS 5,421,920 A 6/1995 Yamamoto et al.
2009/0092515 A1 4/2009 Nakashima et al.
(Continued)

FOREIGN PATENT DOCUMENTS

CN 101608283 A 12/2009
CN 2014-029019 A 2/2014
(Continued)

OTHER PUBLICATIONS

International Search Report and Written Opinion issued in corresponding International Application No. PCT/KR2018/015029 dated Feb. 28, 2019, with English translation.
(Continued)

*Primary Examiner* — Jenny R Wu
(74) *Attorney, Agent, or Firm* — Morgan, Lewis & Bockius LLP

(57) ABSTRACT

A structural steel having excellent brittle crack propagation resistance, according to one aspect of the present invention, comprises, by wt %, 0.02-0.12% of C, 0.01-0.8% of Si, 1.7-2.5% of Mn, 0.005-0.5% of Al, and the balance of Fe and inevitable impurities, wherein an outer surface part and an inner center part thereof are microstructurally distinguished in the thickness direction, and the surface part comprises tempered bainite as a base structure, comprises fresh martensite as a second structure and can comprise austenite as a residual structure.

16 Claims, 2 Drawing Sheets

(51) Int. Cl.

| | |
|---|---|
| ***C21D 8/02*** | (2006.01) |
| ***C22C 38/00*** | (2006.01) |
| ***C22C 38/02*** | (2006.01) |
| ***C22C 38/06*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C22C 38/54*** | (2006.01) |
| ***C22C 38/58*** | (2006.01) |

(52) U.S. Cl.
CPC ..... *C21D 8/0205* (2013.01); *C21D 8/0226* (2013.01); *C22C 38/001* (2013.01); *C22C 38/002* (2013.01); *C22C 38/02* (2013.01); *C22C 38/06* (2013.01); *C22C 38/42* (2013.01); *C22C 38/44* (2013.01); *C22C 38/46* (2013.01); *C22C 38/48* (2013.01); *C22C 38/50* (2013.01); *C22C 38/54* (2013.01); *C22C 38/58* (2013.01); *C21D 2211/001* (2013.01); *C21D 2211/002* (2013.01); *C21D 2211/008* (2013.01)

(58) Field of Classification Search
CPC ..... C21D 6/005; C21D 6/008; C21D 8/00; C21D 8/02; C21D 8/0205; C21D 8/0226; C21D 9/46; C22C 38/001; C22C 38/002; C22C 38/02; C22C 38/04; C22C 38/06; C22C 38/12; C22C 38/14; C22C 38/16; C22C 38/42; C22C 38/44; C22C 38/46; C22C 38/48; C22C 38/50; C22C 38/54; C22C 38/58
See application file for complete search history.

(56) References Cited

U.S. PATENT DOCUMENTS

| | | | | |
|---|---|---|---|---|
| 2015/0232970 | A1 | 8/2015 | Kami et al. | |
| 2016/0017466 | A1 * | 1/2016 | Shibata | C21D 6/002 148/333 |
| 2018/0202017 | A1 | 7/2018 | Drillet et al. | |
| 2018/0363081 | A1 | 12/2018 | Lee et al. | |

FOREIGN PATENT DOCUMENTS

| | | | |
|---|---|---|---|
| EP | 0589424 | A2 | 3/1994 |
| EP | 0709480 | A1 | 5/1996 |
| EP | 2949772 | A1 | 12/2015 |
| EP | 3042976 | A1 | 7/2016 |
| JP | H06-100924 | A | 4/1994 |
| JP | 2002-20835 | A | 1/2002 |
| JP | 2010-196161 | A | 9/2010 |
| JP | 2011-052244 | A | 3/2011 |
| JP | 2013-136827 | A | 7/2013 |
| JP | 2013-147733 | A | 8/2013 |
| JP | 2014-177669 | A | 9/2014 |
| KR | 10-1999-0053985 | A | 7/1999 |
| KR | 10-2008-0027903 | A | 3/2008 |
| KR | 10-0833076 | B1 | 5/2008 |
| KR | 100833076 | B1 * | 5/2008 |
| KR | 10-1253958 | B1 | 4/2013 |
| KR | 10-2013-0114239 | A | 10/2013 |
| KR | 10-2015-0038747 | A | 4/2015 |
| KR | 10-2015-0122779 | A | 11/2015 |
| KR | 10-1726082 | B1 | 4/2017 |
| KR | 10-2017-0140415 | A | 12/2017 |
| WO | 2015/030210 | A1 | 3/2015 |

OTHER PUBLICATIONS

Japanese Office Action dated Sep. 28, 2021 issued in Japanese Patent Application No. 2020-535058.
Extended European Search Report dated Sep. 10, 2020 issued in European Patent Application No. 18891097.0.
Chinese Office Action dated Mar. 31, 2021 issued in Chinese Patent Application No. 201880083644.8 (with English translation).

* cited by examiner

FIG. 1A
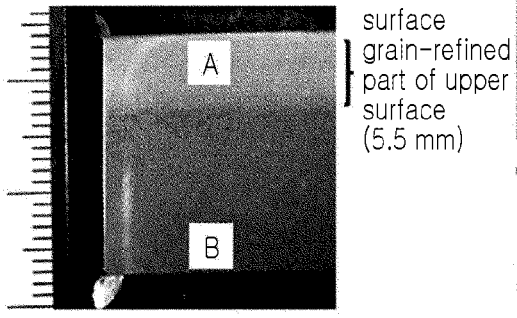
FIG. 1B
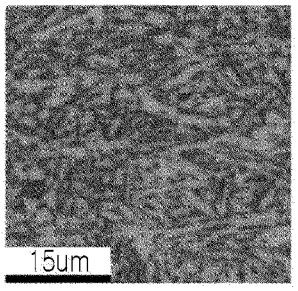
FIG. 1C
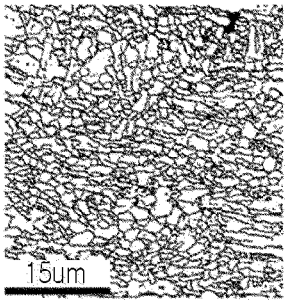
FIG. 1D
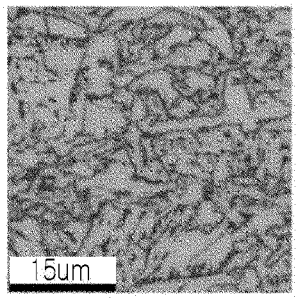
FIG. 1E
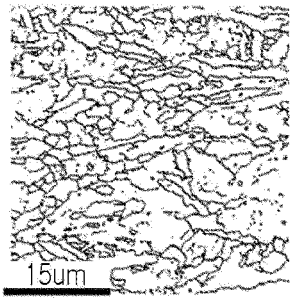
[FIG. 2]
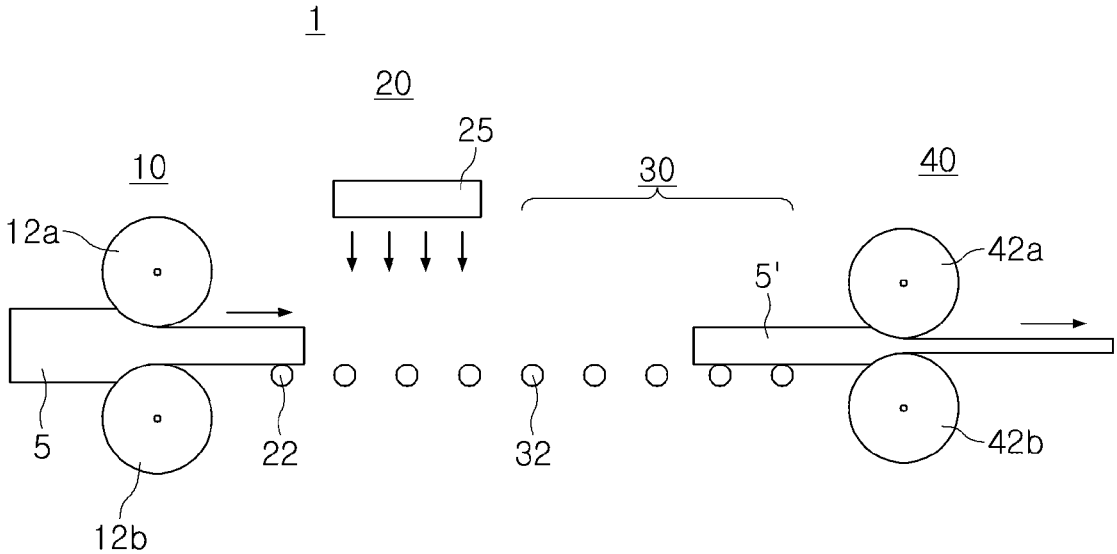

FIG. 3A FIG. 3B FIG. 3C
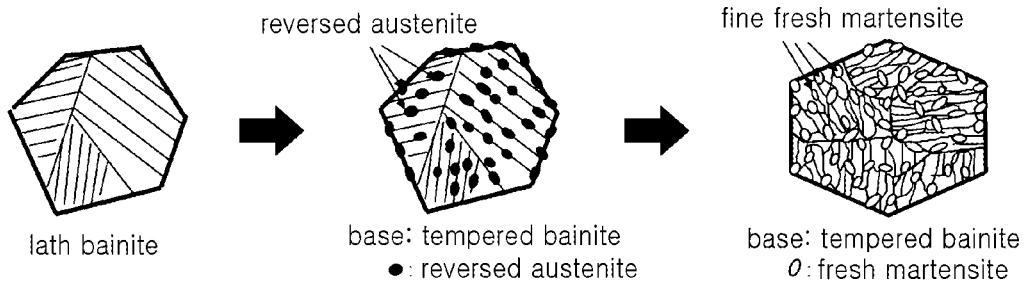
[Fig. 4]
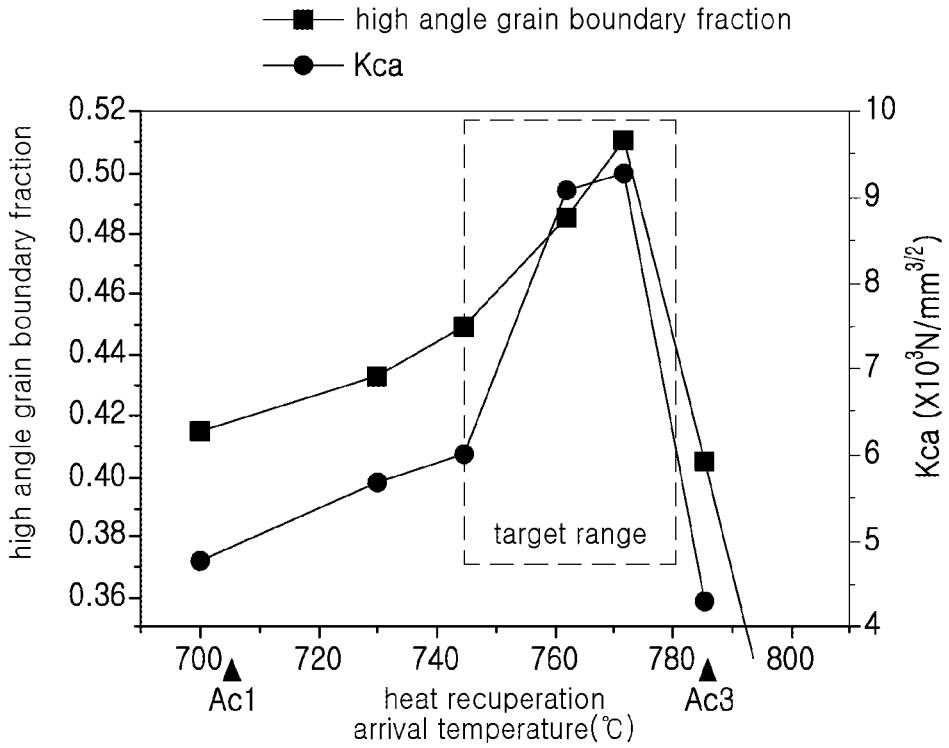

STRUCTURAL STEEL HAVING EXCELLENT BRITTLE CRACK PROPAGATION RESISTANCE, AND MANUFACTURING METHOD THEREFOR

CROSS REFERENCE

This application is the U.S. National Phase under 35 U.S.C. § 371 of International Application No. PCT/KR2018/015029 filed on Nov. 30, 2018, which claims the benefit of Korean Application No. 10-2017-0178930 filed on Dec. 24, 2017, the entire contents of each are hereby incorporated by reference.

TECHNICAL FIELD

The present disclosure relates to a structural steel used in structures such as shipbuilding, architecture, offshore construction, line pipes, and the like and a manufacturing method therefor, and in particular, a structural steel effectively ensuring brittle crack propagation resistance by optimizing a steel composition, a microstructure, and a manufacturing process, and a manufacturing method therefor.

BACKGROUND ART

Various structural materials used in shipbuilding, architecture, offshore construction, line pipes, and the like extend in usage environment to deep sea and polar regions, thus requiring high strength, thickening, and high toughness characteristics. However, in general, as a thickness of a steel sheet increases, performance of stopping propagation of brittle cracks decreases, and thus, a technique for improving the performance of stopping propagation of brittle cracks of high-strength thick steel sheets used in extreme environments is required.

Referring to a process of propagating brittle cracks in steel, it may be seen that brittle cracks occur at a systematically vulnerable center part and propagate. In the case of forming a fine structure on a steel sheet, it may be possible to slow down an occurrence and propagation of brittle cracks, but in the case of a thick plate, a sufficient effect cannot be expected in compacting the structure through cooling and rolling or the like due to a thickness of the thick steel sheet.

Patent document 1 proposes a technique for suppressing propagation of brittle cracks by grain-refining a surface part of a steel, but the surface part is mainly composed of equiaxed ferrite grains and elongated ferrite grains, and thus, the technique cannot be applied to a high-strength steel having a tensile strength of 570 MPa or higher. In addition, in Patent document 1, in order to grain-refine the surface part, a rolling process must be essentially performed in the middle of recuperating heat in the surface part, which makes it difficult to control the rolling process.

(Patent document 1) Japanese Laid-Open Publication No. 2002-020835 (published on Jan. 23, 2002)

DISCLOSURE

Technical Problem

An aspect of the present disclosure is to provide a structural steel which effectively ensures brittle crack propagation resistance by optimizing a steel composition, a microstructure, and a manufacturing process, and a manufacturing method therefor.

The technical problem of the present disclosure is not limited to the above. Those skilled in the art will have no difficulty in understanding the additional technical problem of the present disclosure from the general contents of this specification.

Technical Solution

According to an aspect of the present disclosure, a structural steel having excellent brittle crack propagation resistance includes, by wt %, 0.02 to 0.12% of C, 0.01 to 0.8% of Si, 1.7 to 2.5% of Mn, 0.005 to 0.5% of Al, and the balance of Fe and inevitable impurities, wherein an outer surface part and an inner center part thereof are microstructurally distinguished in a thickness direction, the surface part includes tempered bainite as a base structure, fresh martensite as a second structure, and austenite as a residual structure.

The surface part may be divided into an upper surface part on an upper side and a lower surface part on a lower side, and the upper surface part and the lower surface part may each have a thickness of 3 to 10% of a thickness of the steel.

The base structure and the second structure may be included in a volume fraction of 95% or greater in the surface part.

The residual structure may be included in the surface part at a volume fraction of 5% or less.

An average particle diameter of the tempered bainite may be 3 μm or less (excluding 0 μm).

An average particle diameter of the fresh martensite may be 3 μm or less (excluding 0 μm).

The center part may include acicular ferrite.

An average particle diameter of the acicular ferrite may be 10 to 20 μm.

The steel may further include, by wt %, one or two or more of 0.02% or less of P, 0.01% or less of S, 0.005 to 0.10% of Nb, 0.001% or less of B, 0.005 to 0.1% of Ti, 0.0015 to 0.015% of N, 0.05 to 1.0% of Cr, 0.01 to 1.0% of Mo, 0.01 to 2.0% of Ni, 0.01 to 1.0% of Cu, 0.005 to 0.3% of V, and 0.006% or less of Ca.

The steel may have 2% or greater of an Mn equivalent represented by $Mn_{eq}$ of Equation 1 below.

$$Mn_{eq}=[Mn]+1.5[Cr]+3[Mo]+[Si]/3+[Ni]/3+[Cu]/2+124[B] \quad \text{[Equation 1]}$$

However, in Equation 1, [Mn], [Cr], [Mo], [Si], [Ni], [Cu] and [B] may refer to contents of Mn, Cr, Mo, Si, Ni, Cu, and B, respectively, and may refer to 0 when the corresponding steel composition is not included.

A tensile strength of the steel may be 570 MPa or greater, and a Kca value of the surface part based on −10° C. in a temperature gradient ESSO test may be 6000 $N/mm^{3/2}$ or greater, and a high angle grain boundary fraction of the surface part may be 45% or greater.

According to another aspect of the present disclosure, a method for manufacturing a structural steel having excellent brittle crack propagation resistance includes: reheating a slab including, by wt %, 0.02 to 0.12% of C, 0.01 to 0.8% of Si, 1.7 to 2.5% of Mn, 0.005 to 0.5% of Al, and the balance of Fe and inevitable impurities; rough rolling the slab; first cooling the rough rolled steel; heat recuperating the steel by maintaining a surface part of the first-cooled steel to be reheated by heat recuperation; finish rolling the heat-recuperated steel; and second cooling the finish rolled steel.

The slab may further include, by wt %, one or two or more of 0.02% or less of P, 0.01% or less of S, 0.005 to 0.10% of Nb, 0.001% or less of B, 0.005 to 0.1% of Ti, 0.0015 to 0.015% of N, 0.05 to 1.0% of Cr, 0.01 to 1.0% of Mo, 0.01 to 2.0% of Ni, 0.01 to 1.0% of Cu, 0.005 to 0.3% of V, and 0.006% or less of Ca.

The slab may have 2% or greater of an Mn equivalent represented by $Mn_{eq}$ of Equation 1 below.

$$Mn_{eq}=[Mn]+1.5[Cr]+3[Mo]+[Si]/3+[Ni]/3+[Cu]/2+124[B] \quad \text{[Equation 1]}$$

However, in Equation 1, [Mn], [Cr], [Mo], [Si], [Ni], [Cu] and [B] may refer to contents of Mn, Cr, Mo, Si, Ni, Cu, and B, respectively, and may refer to 0 when the corresponding steel composition is not included.

The surface part may be a region to a depth of 3 to 10% compared to a thickness of the steel from an outer surface of the steel toward the center of the steel.

The reheating temperature may be 1050 to 1250° C., the rough rolling temperature may be Tnr to 1150° C.

The first cooling may be cooling the surface part of the rough rolled steel to a temperature of Ms to Bs° C.

A cooling rate of the first cooling may be 5° C./s or higher.

The first cooling may be performed immediately after the rough rolling.

A starting temperature of the first cooling may be $Ae_3$+100° C. or lower with respect to a temperature of the surface part of the steel.

In the heat recuperation process, the surface part may be reheated to a temperature range of ($Ac_1$+40° C.) to ($Ac_3$−5° C.)

A temperature of the finish rolling may be Bs to Tnr° C.

The second cooling may be cooling the finish rolled steel to a temperature range of Ms to Bs° C. at a cooling rate of 5° C./s or higher.

Advantageous Effects

According to exemplary embodiments in the present disclosure, since the structure of the surface part of the steel is refined by heat recuperation and the high angle grain boundary fraction of the surface part of the steel is increased by limiting a temperature of heat recuperation, the structural steel having effectively improved brittle crack propagation resistance and a manufacturing method therefor may be provided.

In addition, according to exemplary embodiments in the present disclosure, the structural steel having improved brittle crack propagation resistance, while having a tensile strength of 570 MPa or higher, and a manufacturing method therefor may be provided by optimizing steel components, microstructures, and process conditions.

DESCRIPTION OF DRAWINGS

FIGS. 1A-1E are photographs obtained by observing a microstructure of a specimen of a structural steel having excellent brittle crack propagation resistance according to an exemplary embodiment in the present disclosure.

FIG. 2 is a view schematically showing an example of a facility for implementing a manufacturing method of the present disclosure.

FIGS. 3A-3C are conceptual views schematically showing changes in a microstructure of a surface part by heat recuperation of the present disclosure.

FIG. 4 is a graph showing a relationship between a heat recuperation arrival temperature, a high angle grain boundary fraction, and a Kca value at −10° C.

BEST MODE

The present disclosure relates to a structural steel having excellent brittle crack propagation resistance and a manufacturing method therefor, which will be described below with reference to exemplary embodiments in the present disclosure. The exemplary embodiments in the present disclosure may be modified in various forms and the scope of the present disclosure should not be construed as being limited to the exemplary embodiments described below. These exemplary embodiments are provided to describe the present disclosure in more detail to those of ordinary skill in the art.

Hereinafter, a steel composition of the present disclosure will be described in detail. Hereinafter, % is based on a weight representing the content of each element, unless otherwise specified.

A structural steel having excellent brittle crack propagation resistance according to an exemplary embodiment in the present disclosure may include, by wt %, 0.02 to 0.12% of C, 0.01 to 0.8% of Si, 1.7 to 2.5% of Mn, 0.005 to 0.5% of Al, and the balance of Fe and inevitable impurities.

Carbon (C): 0.02 to 0.12%

Carbon (C) is an important element to secure hardenability in the present disclosure and is an element that significantly affects formation of an acicular ferrite structure. Therefore, in the present disclosure, a lower limit of a carbon (C) content may be limited to 0.02% to obtain the effect. However, An excessive addition of carbon (C) may cause formation of pearlite instead of formation of the acicular ferrite, having a possibility of lowering low-temperature toughness, and thus, in the present disclosure, an upper limit of the carbon (C) content may be limited to 0.12%. Therefore, the carbon (C) content of the present disclosure may be 0.02 to 0.12%. Furthermore, in the case of a plate material used as a welding structure, the range of the carbon (C) content may be limited to 0.03 to 0.09% in order to secure weldability.

Silicon (Si): 0.01 to 0.8%

Silicon (Si) is an element used as a deoxidizer and is also an element contributing to strength improvement and toughness improvement. Therefore, in order to obtain such effects, in the present disclosure, a lower limit of a silicon (Si) content may be limited to 0.01%. However, an excessive addition of the content of silicon (Si) may reduce low-temperature toughness and weldability, and thus, in the present disclosure, an upper limit of the silicon (Si) content is limited to 0.8%. Therefore, the silicon (Si) content of the present disclosure may be 0.01 to 0.8%, and a more preferable silicon (Si) content may be 0.05 to 0.5%.

Manganese (Mn): 1.7 to 2.5%

Manganese (Mn) is an element useful for improving strength by solid solution strengthening and is also an element that may economically increase hardenability. Therefore, in order to obtain such effects, in the present disclosure, a lower limit of the manganese (Mn) content may be limited to 1.7%. However, an excessive addition of the Mn content may significantly reduce toughness of a welded portion due to an increase in excessive hardenability, and thus, in the present disclosure, an upper limit of the manganese (Mn) content may be limited to 2.5%. Therefore, the manganese (Mn) content of the present disclosure may be 1.7 to 2.5%, and a more preferable manganese (Mn) content may be 1.75 to 2.3%.

Aluminum (Al): 0.0005 to 0.5%

Aluminum (Al) is a typical deoxidizer which may economically deoxidizing molten steel and is also an element contributing to strength improvement. Therefore, in order to achieve the effect, in the present disclosure, a lower limit of the aluminum (Al) content may be to 0.0005%. However, an excessive addition of aluminum (Al) may cause clogging of a nozzle during continuous casting, and thus, in the present disclosure, an upper limit of the aluminum (Al) content may be limited to 0.5%. Therefore, the aluminum (Al) content of the present disclosure may be 0.0005 to 0.5%, and a more preferable aluminum (Al) content may be 0.0005 to 0.1%.

The structural steel having excellent brittle crack propagation resistance according to an aspect of the present disclosure may further include, by wt %, one or two or more of 0.02% or less of P, 0.01% or less of S, 0.005 to 0.10% of Nb, 0.001% or less of B, 0.005 to 0.1% of Ti, 0.0015 to 0.015% of N, 0.05 to 1.0% of Cr, 0.01 to 1.0% of Mo, 0.01 to 2.0% of Ni, 0.01 to 1.0% of Cu, 0.005 to 0.3% of V, and 0.006% or less of Ca.

Phosphorus (P): 0.02% or Less

Phosphorus (P) is an element advantageous for strength improvement and corrosion resistance, but it is preferable to keep the content thereof as low as possible because phosphorus may significantly lower impact toughness. Therefore, the phosphorus (P) content of the present disclosure may be 0.02% or less, and a more preferable phosphorus (P) content may be 0.015% or less.

Sulfur (S): 0.01% or Less

Sulfur (S) is an element which forms a non-metallic inclusion such as MnS or the like to significantly hamper impact toughness, and thus, it is preferable to keep the content as low as possible. Therefore, the sulfur (S) content of the present disclosure is preferably limited to 0.01% or less. However, sulfur (S) is an impurity inevitably introduced in a steelmaking process, and it is not preferable to control the sulfur (S) to a level of less than 0.001% economically. Therefore, a preferred sulfur (S) content of the present disclosure may be in the range of 0.001 to 0.01%.

Niobium (Nb): 0.005 to 0.1%

Niobium (Nb) is one of the elements that play the most important role in a production of TMCP steel and is also an element precipitated in the form of carbide or nitride to significantly contribute to improving strength of a base material and the welded portion. In addition, niobium (Nb) dissolved during reheating of a slab suppresses recrystallization of austenite and suppresses transformation of ferrite and bainite to refine a structure. In the present disclosure, niobium (Nb) may be added in an amount of 0.005% or greater. However, an excessive addition of niobium (Nb) may form coarse precipitates to cause brittle cracks at corners of the steel, and thus, the niobium (Nb) content may be limited to 0.1% or less. Therefore, the niobium (Nb) content of the present disclosure may be in the range of 0.005 to 0.1%, and a more preferable niobium (Nb) content may be in the range of 0.005 to 0.05%.

Boron (B): 0.001% or Less

Boron (B) is an inexpensive additional element but is also a beneficial element that may effectively increase hardenability even with a small amount of addition. However, the present disclosure aims to form an acicular ferrite structure at the center, but an excessive addition of the content of boron (B) may significantly contribute to formation of bainite to make it impossible to form a dense acicular ferrite structure. Therefore, in the present disclosure, an upper limit of the boron (B) content may be limited to 0.001%.

Titanium (Ti): 0.005 to 0.1%

Titanium (Ti) is an element that significantly suppresses growth of crystal grains at the time of reheating, thereby significantly improving low-temperature toughness. Therefore, in order to obtain such effects, in the present disclosure, a lower limit of the titanium (Ti) content may be limited to 0.005%. However, an excessive addition of titanium (Ti) may cause a problem such as clogging of a nozzle in continuous casting or a reduction of low-temperature toughness due to crystallization of the center part, and thus, in the present disclosure, an upper limit of the titanium (Ti) content may be limited to 0.1%. Therefore, the titanium (Ti) content of the present disclosure may be 0.005 to 0.1%, and a more preferable titanium (Ti) content may be 0.005 to 0.05%.

Nitrogen (N): 0.0015 to 0.015%

Nitrogen (N) is an element that contributes to strength improvement of the steel. However, an excessive addition of the nitrogen (N) content may significantly reduce toughness of the steel, and thus, in the present disclosure, the nitrogen (N) content may be limited to 0.015% or less. However, nitrogen (N) is an impurity inevitably introduced in the steelmaking process and it is not preferable to control the nitrogen (N) content to a level of less than 0.0015% economically. Therefore, the nitrogen (N) content of the present disclosure may be 0.0015 to 0.015%.

Chromium (Cr): 0.05 to 1.0%

Chromium (Cr) is an element that effectively contributes to an increase in strength by increasing hardenability, and thus, in the present disclosure, chromium (Cr) of 0.05% or greater may be added to ensure strength. However, an excessive addition of chromium (Cr) may significantly reduce weldability, and thus, in the present disclosure, an upper limit of the chromium (Cr) content may be limited to 1.0%. Therefore, the chromium (Cr) content of the present disclosure may be in the range of 0.05 to 1.0%, and a more preferable chromium (Cr) content may be 0.05 to 0.5%.

Molybdenum (Mo): 0.01 to 1.0%

Molybdenum (Mo) is an element capable of significantly improving hardenability even with a small amount of addition and suppressing formation of ferrite and thereby significantly improving strength of steel. Therefore, molybdenum (Mo) may be added in an amount of 0.01% or more in terms of ensuring strength. However, an excessive addition of the molybdenum (Mo) content may excessively increase hardness of the welded portion and hinder toughness of the base material, and thus, in the present disclosure, an upper limit of the molybdenum (Mo) content may be limited to 1.0%. Therefore, the molybdenum (Mo) content of the present disclosure may be in the range of 0.01 to 1.0% and a more preferable molybdenum (Mo) content may be 0.01 to 0.5%.

Nickel (Ni): 0.01 to 2.0%

Nickel (Ni) is an element capable of improving both strength and toughness of a base material, and thus, in the present disclosure, 0.01% or more of nickel (Ni) may be added to ensure strength and toughness. However, nickel (Ni) is an expensive element and an excessive addition thereof is not desirable from the economical point of view and an excessive nickel (Ni) content may degrade weldability, and thus, in the present disclosure, an upper limit of the nickel (Ni) content may be limited to 2.0%. Therefore, the nickel (Ni) content of the present disclosure may be in the range of 0.01 to 2.0%, and a more preferable nickel (Ni) content may be in the range of 0.01 to 1.0%.

Copper (Cu): 0.01 to 1.0%

Copper (Cu) is an element capable of increasing strength while minimizing deterioration of toughness of the base material. Therefore, in the present disclosure, 0.01% or more of copper (Cu) may be added to ensure strength. However, an excessive addition of copper (Cu) may increase a possibility of lowering quality of a surface of a final product, and thus, in the present disclosure, an upper limit of the copper (Cu) content may be limited to 1.0%. Therefore, the copper (Cu) content of the present disclosure may be 0.01 to 1.0%, and a more preferable copper (Cr) content may be 0.01 to 0.5%.

Vanadium (V): 0.005 to 0.3%

Vanadium (V) has a low solution temperature compared to other alloy compositions and precipitated at a welding heat affecting portion to prevent lowering of strength of a welded portion. Thus, in order to obtain such effects, in the present disclosure, a lower limit of the vanadium (V) content may be limited to 0.005%. However, an excessive addition of vanadium (V) may lower toughness, and thus, in the present disclosure, an upper limit of the vanadium (V) content may be limited to 0.3%. Therefore, the vanadium (V) content of the present disclosure may be 0.005 to 0.3%, and a more preferable vanadium (V) content may be 0.01 to 0.3%.

Calcium (Ca): 0.006% or Less

Calcium (Ca) is mainly used as an element that controls a shape of a non-metallic inclusion, such as MnS or the like and improves low-temperature toughness. However, an excessive addition of calcium (Ca) may cause formation of a large amount of CaO—CaS and formation of coarse inclusion, which may lower cleanliness of the steel and weldability in the field. Therefore, in the present disclosure, an upper limit of the calcium (Ca) content may be limited to 0.006%, and a more preferable upper limit of the calcium (Ca) content may be 0.003%.

In the present disclosure, the balance other than the steel composition may be Fe and inevitable impurities. The inevitable impurities, which may be unintentionally incorporated in a general steel manufacturing process, cannot be completely excluded, which may be easily understood by those skilled in the general steel manufacturing field. In addition, in the present disclosure, an addition of other compositions than the steel compositions mentioned above is not completely excluded.

A thickness of the structural steel having excellent brittle crack propagation resistance according to an aspect of the present disclosure is not particularly limited and may preferably be a thick structural steel having a thickness of 50 mm or greater.

Hereinafter, limiting conditions of an Mn equivalent of the present disclosure will be described in detail.

Limiting Conditions of Mn Equivalent

In the steel composition of the present disclosure, the Mn equivalent represented by $Mn_{eq}$ in Equation 1 below should satisfy 2% or more.

$$Mn_{eq}=[Mn]+1.5[Cr]+3[Mo]+[Si]/3+[Ni]/3+[Cu]/2+124[B] \quad \text{[Equation 1]}$$

However, [Mn], [Cr], [Mo], [Si], [Ni], [Cu], and [B] in Equation 1 refer to contents of Mn, Cr, Mo, Si, Ni, Cu, and B, respectively, and refer to 0 if the corresponding steel composition is not included.

As described below, the present disclosure aims to form a lath bainite structure on the surface part by performing the first cooling on the roughly rolled steel after the end of rough rolling, and the Mn equivalent of 2% or more corresponds to necessary conditions for forming the lath bainite structure on the surface part by first cooling. If the Mn equivalent is less than 2%, hardenability is not ensured and a polygonal ferrite or a granular bainite structure other than the lath bainite structure is formed on the surface part even by the first cooling. Therefore, in the present disclosure, preferably, the steel composition content is limited so that the Mn equivalent represented by $Mn_{eq}$ in Equation 1 satisfies 2% or more.

Hereinafter, a microstructure of the present disclosure will be described in detail.

Microstructure

The steel of the present disclosure may be divided into an outer surface part and an inner center part along a thickness direction, and the surface part and the center part may be microstructurally distinguished from each other. The surface part is divided into an upper surface part on an upper side of the steel and a lower surface part on a lower side of the steel, and thicknesses of the upper surface part and the lower surface part may be 3 to 10% of the thickness of the steel. Preferably, the thicknesses of the upper surface part and the lower surface part may be 5 to 7% of the thickness of the steel.

The surface part may be provided as a mixed structure including tempered bainite as a base structure, fresh martensite as a second structure, and austenite as a residual structure, and the center part may be provided as a structure including acicular ferrite. Therefore, the surface part and the center part may be microstructurally distinguished from each other.

The sum of volume fractions of the tempered bainite structure and the fresh martensite structure in the surface part may be 95% or more, and a volume fraction of residual austenite in the surface part may be 5% or less. In addition, the volume fraction of the tempered bainite structure in the surface part may be 85% or more and the volume fraction of fresh martensite structure may be 10% or less. In addition, the sum of the volume fractions of the tempered bainite structure and fresh martensite structure in the surface part may be 100%, in which case residual austenite may not be present in the surface part.

The center part may include 95% or more of acicular ferrite and 5% or more of cementite in a volume fraction.

In the steel of the present disclosure, the surface part is refined by heat recuperation, and thus, an acicular ferrite structure at the center part of a final product may have an average particle size of 10 to 20 μm level, while the tempered bainite structure and the fresh martensite structure of the surface part may be provided as fine structures each having an average particle diameter of 3 μm or less.

FIGS. 1A-1E are photographs obtained by observing a microstructure of a specimen according to an exemplary embodiment in the present disclosure. Specifically, FIG. 1A is a photograph of a surface part A and a center part B divided on the specimen, FIG. 1B is an optical photograph of the surface part A region, FIG. 1C shows a high angle grain boundary map photographed using electron back scattering diffraction (EBSD) for the surface part A region, FIG. 1D is an optical photograph of the center part B region, and FIG. 1E shows a high angle grain boundary map photographed using EBSD for the center part B region. As shown in FIG. 1A, the surface part A and the center part B are microstructurally distinguished from each other, so that a boundary therebetween is also discernible with the naked eye. In addition, as shown in FIG. 1B to FIG. 1E, an average particle diameter of the acicular ferrite structure of the center part B is about 15 μm, while an average particle diameter of each of the tempered bainite structure and the fresh martensite structure of the surface part A is 3 μm or less. Therefore, the steel according to an exemplary embodiment in the present disclosure may have effectively improved brittle crack propagation resistance by microstructuring the surface part of the steel through heat recuperation.

In the steel according to one aspect of the present disclosure, the surface part is microstructured by heat recuperation, and thus, a Kca value of the surface part with respect to −10° C. in a temperature gradient ESSO test is 6000 $N/mm^{3/2}$ or higher and a high angle grain boundary fraction of the surface part may be 45% or greater. In addition, since the steel according to one aspect of the present disclosure has a tensile strength of 570 MPa or greater, a high-strength steel having excellent brittle crack propagation resistance may be provided.

The structural steel having excellent brittle crack propagation resistance according to an aspect of the present disclosure may be manufactured by reheating a slab provided with the afore-mentioned composition; rough rolling the slab; first cooling the rough rolled steel; recuperating heat in the steel by maintaining a surface part of the first-cooled steel to be reheated by heat recuperation; finish rolling the heat-recuperated steel; and second cooling the finish rolled steel. The reason for limiting the composition of the slab corresponds to the reason for limiting the steel composition described above, and thus, the reason for limiting the composition of the slab is replaced by the reason for limiting the steel composition described above.

Hereinafter, a manufacturing method of the present disclosure will be described in detail.

Slab Reheating

The reheating temperature of the slab may be limited to 1050° C. or higher to sufficiently dissolve the carbonitrides of Ti and Nb formed during casting. However, if the reheating temperature is excessively high, austenite may become coarse and it takes an excessive time for the temperature of the surface part of the steel to reach a first cooling starting temperature after rough rolling, so an upper limit of the reheating temperature may be limited to 1250° C.

Rough Rolling

Rough rolling is performed after reheating to adjust a shape of the slab and to destroy a casting structure such as dendrites. In order to control the microstructure, rough rolling is performed at a temperature Tnr or higher at which austenite recrystallization stops, and an upper limit of the temperature of the rough rolling may be limited to 1150° C. in consideration of the first cooling starting temperature. Therefore, the temperature of rough rolling of the present disclosure may range from Tnr to 1150° C.

First Cooling

After the end of rough rolling, first cooling is performed until the temperature of the surface part reaches the range of Ms to Bs° C. in order to form lath bainite at the surface part of the steel. If a cooling rate of the first cooling is less than 5° C./s, a polygonal ferrite or granular bainite structure other than the lath bainite structure may be formed on the surface part, and thus, the cooling rate of the first cooling may be 5° C./s or higher. Further, the first cooling method is not particularly limited but water cooling is preferred from the viewpoint of cooling efficiency. Meanwhile, if the starting temperature of the first cooling is too high, there is a possibility that the lath bainite structure formed on the surface part may become coarse by the first cooling, and thus, the starting temperature of the first cooling is preferably limited to $Ae_3$+100° C. or lower.

In order to maximize the effect of heat recuperation, the first cooling of the present disclosure is preferably performed immediately after rough rolling. FIG. 2 is a view schematically showing an example of a facility 1 for implementing a manufacturing method of the present disclosure. A rough rolling device 10, a cooling device 20, a heat recuperator 30, and a finish rolling device 40 are sequentially arranged along a movement path of a slab 5, and the rough rolling device 10 and the finish rolling device 40 include rough rolling rollers 12*a* and 12*b* and finish rolling rollers 42*a* and 42*b*, respectively, to perform rolling on the slab 5. The cooling device 20 may include a bar cooler 25 for spraying cooling water and an auxiliary roller 22 for guiding movement of the rough rolled slab 5. The bar cooler 25 is preferably disposed in an immediate rear of the rough rolling device 10 in terms of maximizing a heat recuperation effect. The heat recuperator 30 is disposed at a rear of the cooling device 20, and the rough rolled slab 5 may be heat-recuperated while moving along an auxiliary roller 32. A heat-recuperated slab 5' may be moved to the finish rolling device 40 to be finish rolled. Such a facility 1 is merely an example of a facility for carrying out the present disclosure, and the present disclosure should not be interpreted as being limited to the facility shown in FIG. 2.

Heat Recuperation

After the first cooling, heat recuperation may be performed to allow the surface part of the steel to be reheated by high heat at the center part of the steel, and the heat recuperation may be performed until a temperature of the surface part of the steel reaches ($A_{c1}$+40° C.) to ($A_{c3}$−5° C.)). By the heat recuperation, the lath bainite of the surface part may be transformed into fine tempered bainite and fresh martensite, and part of the lath bainite of the surface part may be reverse-transformed into austenite.

FIG. 3A-3C are conceptual views schematically showing changes in a microstructure of a surface part by heat recuperation of the present disclosure.

As shown in FIG. 3A, the microstructure of the surface part immediately after the first cooling may be provided as a lath bainite structure. As shown in FIG. 3B, as heat recuperation proceeds, the lath bainite of the surface part is transformed into a tempered bainite structure and part of the lath bainite of the surface part may be reverse-transformed into austenite. As the finish rolling and the second cooling are performed after the heat recuperation, as shown in FIG. 3C, 2-phase mixed structure of the tempered bainite base structure and the fresh martensite may be formed and part of the austenite structure may remain.

A relationship between a heat recuperation arrival temperature, the high angle grain boundary fraction, and the Kca value at −10° C. is as shown in FIG. 4. As shown in FIG. 4, it can be seen that when the arrival temperature of the surface part is lower than ($Ac_1$+40° C.), the high angle grain boundary of 15 degrees or more is not sufficiently formed and the Kca value at −10° C. is not sufficiently secured. Therefore, in the present disclosure, a lower limit of the heat recuperation arrival temperature of the surface part may be limited to ($Ac_1$+40° C.). Also, if the surface part arrival temperature exceeds ($Ac_3$−5° C.) there is no significant advantage regarding a crack propagation rate and the structure of the surface part is likely to become coarse again, and thus, in the present disclosure, an upper limit of the heat recuperation arrival temperature of the surface part may be limited to ($Ac_3$−5° C.) That is, in the present disclosure, by limiting the surface part arrival temperature to the temperature range of ($Ac_1$+40° C.) to ($Ac_3$−5° C.), microstructuring of the surface part, 45% or more of high angle grain boundary fraction of 15 degrees or more, and the Kca value of 6000 N/mm$^{3/2}$ at 10° C. may be ensured.

Finish Rolling

In order to introduce a non-uniform microstructure into the austenitic structure of the rough rolled steel, finish rolling is performed. The finish rolling is carried out in a temperature range above a bainite transformation starting temperature Bs and below an austenite recrystallization temperature Tnr.

Second Cooling

After the finish rolling terminates, cooling is performed at a cooling rate of 5° C./s or higher in order to form an acicular ferrite structure at the center part of the steel. The second cooling method is not particularly limited but water cooling is preferred from the viewpoint of cooling efficiency. If an arrival temperature of the second cooling exceeds Bs° C. based on the steel, the structure of the acicular ferrite becomes coarse and an average particle diameter of the acicular ferrite may exceed 20 μm. In addition, if the arrival temperature of the second cooling is lower than Ms° C. based on the steel, there may be a possibility that the steel is twisted, and thus, the arrival temperature of the second cooling is preferably limited to Ms to Bs° C.

MODE FOR INVENTION

Hereinafter, the present disclosure will be described in detail through examples. However, it is necessary to note that the exemplary embodiments described below are only intended to further illustrate the present disclosure and are not intended to limit the scope of the present disclosure.

Slabs having the compositions of Table 1 below were prepared, and transformation temperatures and Mn equivalents of the slabs based on Table 1 were calculated and shown in Table 2.

TABLE 1

| Classification | C | Si | Mn | P | S | Al | Ni | Cu | Cr | Mo | Ti | Nb | V | B | Ca* | N* |
|---|---|---|---|---|---|---|---|---|---|---|---|---|---|---|---|---|
| Steel A | 0.07 | 0.15 | 1.9 | 0.009 | 0.004 | 0.028 | 0.45 | 0.1 | 0.24 | 0.02 | 0.015 | 0.02 | 0.10 | 0.0005 | 10 | 41 |
| Steel B | 0.062 | 0.18 | 1.75 | 0.001 | 0.004 | 0.027 | 0.1 | 0.03 | 0.06 | 0.03 | 0.013 | 0.03 | 0.05 | 0.0003 | 15 | 35 |
| Steel C | 0.057 | 0.3 | 2.15 | 0.012 | 0.002 | 0.023 | 0.33 | 0.16 | 0.1 | 0.015 | 0.015 | 0.04 | 0.15 | 0.0009 | 0 | 45 |
| Steel D | 0.078 | 0.45 | 2.1 | 0.013 | 0.003 | 0.035 | 0.43 | 0.15 | 0.46 | 0.2 | 0.019 | 0.04 | 0.05 | 0.001 | 4 | 41 |
| Steel E | 0.048 | 0.25 | 2.3 | 0.013 | 0.002 | 0.03 | 0.3 | 0.26 | 0.05 | 0.05 | 0.018 | 0.03 | 0.20 | 0.0007 | 0 | 43 |
| Steel F | 0.015 | 0.21 | 1.5 | 0.014 | 0.002 | 0.035 | 0.1 | 0.1 | 0.06 | 0.03 | 0.012 | 0.03 | 0.01 | 0.0008 | 3 | 38 |
| Steel G | 0.15 | 0.32 | 0.8 | 0.013 | 0.001 | 0.04 | 0.05 | 0.02 | 0.1 | 0.05 | 0.016 | 0.03 | 0.01 | 0.0003 | 0 | 35 |
| Steel H | 0.08 | 0.42 | 1.22 | 0.011 | 0.003 | 0.24 | 0.2 | 0.05 | 0.15 | 005 | 0.012 | 0.04 | 0.02 | 0.0002 | 10 | 32 |
| Steel I | 0.79 | 0.25 | 1.4 | 0.016 | 0.004 | 0.03 | 0.11 | 0.2 | 0.05 | 0.07 | 0.01 | 0.04 | 0.03 | 0.0001 | 9 | 50 |
| Steel J | 0.07 | 0.12 | 1.70 | 0.008 | 0.004 | 0.026 | 0.1 | 0.02 | 0.05 | 0.015 | 0.017 | 0.03 | 0.05 | 0.0002 | 8 | 42 |

The contents of alloy compositions of Table 1 is based on wt % but Ca* and N* are based on ppm.

TABLE 2

| Classification | Bs (° C.) | Tnr (° C.) | Ms (° C.) | $Ac_3$ (° C.) | $Ac_1$ (° C.) | $Mn_{eq}$ (° C.) | Remark |
|---|---|---|---|---|---|---|---|
| Steel A | 605 | 941 | 441 | 791 | 703 | 2.6 | Inventive steel |
| Steel B | 645 | 917 | 457 | 804 | 709 | 2.1 | Inventive steel |

TABLE 2-continued

| Classification | Bs (° C.) | Tnr (° C.) | Ms (° C.) | $Ac_3$ (° C.) | $Ac_1$ (° C.) | $Mn_{eq}$ (° C.) | Remark |
|---|---|---|---|---|---|---|---|
| Steel C | 601 | 978 | 442 | 802 | 705 | 2.7 | Inventive steel |
| Steel D | 555 | 906 | 427 | 793 | 714 | 3.9 | Inventive steel |
| Steel E | 591 | 982 | 442 | 803 | 701 | 2.9 | Inventive steel |
| Steel F | 691 | 933 | 487 | 821 | 713 | 1.7 | Comparative steel |
| Steel G | 718 | 953 | 451 | 791 | 724 | 1.0 | Comparative steel |
| Steel H | 674 | 905 | 464 | 817 | 728 | 1.9 | Comparative steel |
| Steel I | 677 | 988 | 462 | 797 | 715 | 1.7 | Comparative steel |
| Steel J | 650 | 968 | 455 | 793 | 707 | 1.9 | Comparative steel |

The slabs having the compositions of Table 1 were subjected to rough rolling, first cooling and heat recuperation under the conditions of Table 3 below and subjected to finish rolling and second cooling under the conditions of Table 4. The results for the steels prepared under the conditions of Table 3 and Table 4 are shown in Table 5 below.

For each steel, an average grain diameter, high angle grain boundary fraction, mechanical properties, and Charpy impact absorption energy and crack propagation rate at a ¼ point of thickness at −40° C. of the surface part and the center part (¼ point of thickness) were measured. Among these, the high angle grain boundary fraction was measured in a 500 m×500 m region at 0.5 m step size by electron back scattering diffraction (EBSD) method, a grain boundary map with a crystal orientation difference of 15 degrees or more with adjacent particles was created, and the average grain diameters and high angle grain boundary fractions were obtained. Average values of yield strength (YS) and tensile strength (TS) were obtained by testing tension of three specimens in a plate width direction. An average value of the Charpy impact absorption energy of −40° C. was obtained by collecting three specimens in a rolling direction at the ¼ point of the thickness. In addition, crack resistance was tested by a standard ESSO test of a temperature gradient type (500 mm×500 mm specimen collected from a steel sheet having an original thickness).

TABLE 3

| Classification | Condition for reheat and rough rolling | | | | Condition for first cooling First | Condition for heat recuperation Heat | Remark |
|---|---|---|---|---|---|---|---|
| | Thickness before rough rolling (mm) | Thickness after rough rolling (mm) | Reheat extraction temperature (° C.) | Rough rolling termination temperature (° C.) | cooling termination surface temperature (° C.) | recuperation arrival surface temperature (° C.) | |
| Steel A-1 | 254 | 80 | 1080 | 1000 | 545 | 777 | Recommended condition |
| Steel A-2 | 280 | 30 | 1075 | 980 | 521 | 774 | Recommended condition |
| Steel A-3 | 280 | 55 | 1100 | 995 | 461 | 772 | Recommended condition |
| Steel A-4 | 254 | 65 | 1110 | 1070 | 647 | 855 | Exceeding Heat recuperation temperature |
| Steel A-5 | 245 | 35 | 1125 | 950 | 421 | 701 | Below heat recuperation temperature |
| Steel A-6 | 220 | 70 | 1050 | 1020 | 531 | 759 | Recommended condition |
| Steel B-1 | 285 | 85 | 1070 | 970 | 555 | 776 | Recommended condition |
| Steel B-2 | 280 | 40 | 1080 | 955 | 550 | 761 | Recommended condition |
| Steel B-3 | 220 | 55 | 1105 | 1035 | 546 | 774 | Recommended condition |
| Steel B-4 | 244 | 35 | 1100 | 1080 | 655 | 857 | Exceeding Heat recuperation temperature |
| Steel B-5 | 220 | 75 | 1075 | 990 | 435 | 710 | Below heat recuperation temperature |
| Steel C-1 | 254 | 90 | 1085 | 1000 | 555 | 779 | Recommended condition |
| Steel C-2 | 270 | 30 | 1065 | 990 | 530 | 777 | Recommended condition |
| Steel C-3 | 255 | 70 | 1110 | 1085 | 663 | 871 | Exceeding Heat recuperation temperature |
| Steel C-4 | 245 | 30 | 1060 | 980 | 420 | 723 | Below heat recuperation temperature |
| Steel C-5 | 250 | 45 | 1085 | 1030 | 480 | 780 | Recommended condition |
| Steel D-1 | 275 | 60 | 1080 | 980 | 515 | 769 | Recommended condition |
| Steel D-2 | 255 | 30 | 1070 | 990 | 480 | 754 | Recommended condition |
| Steel D-3 | 230 | 55 | 1100 | 1040 | 620 | 807 | Exceeding Heat recuperation temperature |
| Steel D-4 | 250 | 40 | 1020 | 950 | 410 | 703 | Below heat recuperation temperature |
| Steel E-1 | 255 | 70 | 1085 | 985 | 563 | 771 | Recommended condition |
| Steel E-2 | 280 | 25 | 1075 | 990 | 515 | 780 | Recommended condition |
| Steel E-3 | 270 | 55 | 1110 | 990 | 525 | 776 | Recommended condition |
| Steel F-1 | 245 | 75 | 1090 | 1000 | 561 | 774 | Recommended condition |
| Steel G-1 | 255 | 60 | 1090 | 990 | 568 | 776 | Recommended condition |
| Steel H-1 | 280 | 55 | 1080 | 950 | 570 | 789 | Recommended condition |
| Steel I-1 | 285 | 70 | 1080 | 990 | 500 | 780 | Recommended condition |
| Steel J-1 | 280 | 75 | 1095 | 980 | 515 | 763 | Recommended condition |

TABLE 4

| Classification | Condition for finish rolling: Finish rolling termination temperature (° C.) | Condition for second cooling: Second cooling rate (° C./sec) | Condition for second cooling: Second cooling termination temperature (° C.) | Remark |
|---|---|---|---|---|
| Steel A-1 | 850 | 6 | 520 | Recommended condition |
| Steel A-2 | 855 | 18 | 590 | Recommended condition |
| Steel A-3 | 827 | 11 | 530 | Recommended condition |
| Steel A-4 | 895 | 8 | 550 | Recommended condition |
| Steel A-5 | 800 | 21 | 510 | Recommended condition |
| Steel A-6 | 870 | 7 | 630 | Above second cooling termination temperature |
| Steel B-1 | 860 | 7 | 510 | Recommended condition |
| Steel B-2 | 855 | 15 | 497 | Recommended condition |
| Steel B-3 | 845 | 13 | 535 | Recommended condition |
| Steel B-4 | 875 | 21 | 520 | Recommended condition |
| Steel B-5 | 830 | 9 | 550 | Recommended condition |
| Steel C-1 | 865 | 6 | 510 | Recommended condition |
| Steel C-2 | 845 | 24 | 480 | Recommended condition |
| Steel C-3 | 915 | 11 | 500 | Recommended condition |

TABLE 4-continued

| Classification | Condition for finish rolling: Finish rolling termination temperature (° C.) | Condition for second cooling: Second cooling rate (° C./sec) | Condition for second cooling: Second cooling termination temperature (° C.) | Remark |
|---|---|---|---|---|
| Steel C-4 | 835 | 26 | 450 | Recommended condition |
| Steel C-5 | 765 | 17 | 670 | Above second cooling termination temperature |
| Steel D-1 | 850 | 14 | 535 | Recommended condition |
| Steel D-2 | 855 | 27 | 535 | Recommended condition |
| Steel D-3 | 860 | 17 | 480 | Recommended condition |
| Steel D-4 | 825 | 14 | 490 | Recommended condition |
| Steel E-1 | 867 | 11 | 510 | Recommended condition |
| Steel E-2 | 875 | 29 | 530 | Recommended condition |
| Steel E-3 | 885 | 2 | 485 | Below second cooling rate |
| Steel F-1 | 865 | 7 | 550 | Recommended condition |
| Steel G-1 | 845 | 12 | 540 | Recommended condition |
| Steel H-1 | 875 | 13 | 590 | Recommended condition |
| Steel I-1 | 855 | 9 | 555 | Recommended condition |
| Steel J-1 | 852 | 14 | 535 | Recommended condition |

TABLE 5

| Classification | Average grain diameter: Surface part (μm) | Average grain diameter: ¼t point (μm) (t: thickness) | Physical properties: YS (MPa) | Physical properties: TS (MPa) | Physical properties: High angle gran boundary fraction (%) | Physical properties: ¼t Charpy impact absorption energy (J, @ −40° C.) (t: thickness) | Crack resistance: Kca value at −10° C. ($N/mm^{3/2}$) (temperature gradient ESSO test result) | Remark |
|---|---|---|---|---|---|---|---|---|
| Steel A-1 | 2 | 13 | 504 | 654 | 49 | 345 | 8440 | IS |
| Steel A-2 | 2.1 | 9 | 498 | 650 | 48 | 340 | 8200 | IS |
| Steel A-3 | 2.1 | 12 | 500 | 645 | 48 | 335 | 8084 | IS |
| Steel A-4 | 10.1 | 14 | 575 | 693 | 39 | 320 | 3416 | CS |
| Steel A-5 | 5.6 | 8 | 535 | 653 | 42 | 355 | 5193 | CS |
| Steel A-6 | 2.6 | 24 | 410 | 550 | 46 | 90 | 7272 | CS |
| Steel B-1 | 2.3 | 11 | 501 | 656 | 47 | 330 | 7672 | IS |
| Steel B-2 | 2.9 | 12 | 496 | 651 | 46 | 345 | 6823 | IS |
| Steel B-3 | 2.4 | 11 | 495 | 647 | 47 | 320 | 7547 | IS |
| Steel B-4 | 10.1 | 9 | 579 | 669 | 39 | 355 | 3416 | CS |
| Steel B-5 | 5.5 | 13 | 526 | 647 | 43 | 335 | 5246 | CS |
| Steel C-1 | 2.1 | 14 | 519 | 658 | 48 | 320 | 8001 | IS |
| Steel C-2 | 2.2 | 9 | 518 | 653 | 48 | 370 | 7854 | IS |
| Steel C-3 | 12.1 | 12 | 521 | 647 | 38 | 325 | 2790 | CS |
| Steel C-4 | 4.9 | 1 | 579 | 669 | 43 | 315 | 5571 | CS |
| Steel C-5 | 2.1 | 26 | 405 | 540 | 48 | 75 | 8051 | CS |
| Steel D-1 | 2.4 | 11 | 551 | 677 | 47 | 325 | 7616 | IS |
| Steel D-2 | 2.8 | 9 | 618 | 715 | 45 | 350 | 6662 | IS |
| Steel D-3 | 10.3 | 10 | 582 | 682 | 39 | 315 | 3363 | CS |
| Steel D-4 | 5.8 | 11 | 558 | 673 | 42 | 315 | 5109 | CS |
| Steel E-1 | 2.4 | 12 | 545 | 666 | 47 | 355 | 7530 | IS |
| Steel E-2 | 2.1 | 7 | 633 | 721 | 48 | 365 | 8059 | IS |
| Steel E-3 | 2.2 | 19 | 435 | 560 | 47 | 230 | 7806 | CS |

TABLE 5-continued

| Classification | Average grain diameter: Surface part (μm) | Average grain diameter: ¼t point (μm) (t: thickness) | Physical properties: YS (MPa) | Physical properties: TS (MPa) | Physical properties: High angle gran boundary fraction (%) | Physical properties: ¼t Charpy impact absorption energy (J, @ −40° C.) (t: thickness) | Crack resistance: Kca value at −10° C. ($N/mm^{3/2}$) (temperature gradient ESSO test result) | Remark |
|---|---|---|---|---|---|---|---|---|
| Steel F-1 | 8.6 | 15 | 495 | 630 | 40 | 300 | 3937 | CS |
| Steel G-1 | 11.8 | 19 | 395 | 530 | 38 | 230 | 2894 | CS |
| Steel H-1 | 7.3 | 13 | 460 | 645 | 41 | 333 | 4458 | CS |
| Steel I-1 | 10.1 | 12 | 458 | 625 | 39 | 340 | 3416 | CS |
| Steel J-1 | 3.8 | 14 | 465 | 635 | 38 | 290 | 4031 | CS |

* IS: Inventive Steel/
** CS: Comparative Steel

Steels A, B, C, D, E, and J are steels that satisfy the steel composition content of the present disclosure. Among them, it can be seen that steels A-1. A-2, A-3, B-1, B-2, B-3, C-1, C-2, D-1, D-2, E-1, E-2 that satisfy the process conditions of the present disclosure are steels in which the high angle grain boundary fractions of the surface part are 45% or more, tensile strength is 570 MPa or more, Charpy impact absorption energy at −40° C. is 320 J or more, and the Kca value at −10° C. as a result of temperature gradient ESSO test is 6000 $N/mm^{3/2}$ or more.

It can be seen that steels A-4, B-4, C-3, and D-3 which satisfy the steel composition content of the present disclosure but have a heat recuperation temperature exceeding the range of the present disclosure are steels in which the high angle grain boundary fractions are all less than 45% and the Kca value at −10° C. as a result of temperature gradient ESSO test is less than 6000 $N/mm^{3/2}$. This is because, as the surface part of the steel was heated to a temperature higher than a temperature range of an abnormal region heat treatment temperature section, the structure of the surface part was entirely reverse-transformed into austenite, and as a result, a final structure of the surface part was formed as a structure of lath bainite.

It can be seen that steels A-5, B-5, C-4, and D-4 which satisfy the steel composition content of the present disclosure but whose heat recuperation temperature is less than the range of the present disclosure are steels in which the high angle grain boundary fraction is less than 45% and the Kca value at −10° C. as a result of temperature gradient ESSO test is less than 6000 $N/mm^{3/2}$. This is because, during the first cooling, the surface parts of the steels were excessively cooled, so that the reversed austenite structure in the surface part was not sufficiently formed.

It can be seen that, in the case of steel A-6 and steel C-5, the second cooling termination temperature exceeds the range of the present disclosure, and steel E-3 has a second cooling rate below the range of the present disclosure, so the tensile strength of the steels were not sufficiently ensured.

It can be seen that, steels F-1, G-1, H-1 and I-1 satisfy the process conditions of the present disclosure but manganese equivalents defined by $Mn_{eq}$ are less than 2.0%, the high angle grain boundary fractions are all less than 45%, and the Kca values at −10° C. as a result of temperature gradient ESSO test are less than 6000 $N/mm^{3/2}$. This is because the lath bainite structure was not secured in the surface part of the steels during the first cooling, and thus the surface part was not sufficiently grain-refined. In addition, steel J-1 satisfies the steel composition of the present disclosure, but a manganese equivalent defined by $Mn_{eq}$ does not reach 2.0%, so that the high angle grain boundary fractions are all less than 45% and the Kca values at −10° C. as a result of temperature gradient ESSO test are less than 6000 $N/mm^{3/2}$.

Therefore, it can be seen that the structural steel according to one exemplary embodiment in the present disclosure has excellent brittle crack propagation resistance and has a tensile strength of 570 MPa or higher.

The present disclosure has been described in detail through the above exemplary embodiments, but other types of exemplary embodiments are also possible. Therefore, the technical spirit and scope of the claims set forth below are not limited to the exemplary embodiments.

The invention claimed is:

1. A structural steel, the structural steel comprising, by wt %, 0.02 to 0.12% of C, 0.01 to 0.8% of Si, 1.7 to 2.5% of Mn, 0.005 to 0.5% of Al, and the balance of Fe and inevitable impurities, wherein an outer surface part and an inner center part thereof are microstructurally distinguished in a thickness direction, the surface part includes tempered bainite as a base structure, fresh martensite as a second structure, and austenite as a residual structure, wherein an average particle diameter of the tempered bainite is 3 μm or less, excluding 0 μm, an average particle diameter of the fresh martensite is 3 μm or less, excluding 0 μm, and wherein a Kca value of the surface part based on −10° C. in a temperature gradient ESSO test is 6000 $N/mm^{3/2}$ or greater, and a high angle grain boundary fraction of the surface part is 45% or greater.

2. The structural steel of claim 1, wherein the surface part is divided into an upper surface part on an upper side and a lower surface part on a lower side, and the upper surface part and the lower surface part each have a thickness of 3 to 10% of a thickness of the steel.

3. The structural steel of claim 1, wherein the base structure and the second structure are included in a volume fraction of 95% or greater in the surface part.

4. The structural steel of claim 1, wherein the residual structure is included in the surface part at a volume fraction of 5% or less.

5. The structural steel of claim 1, wherein the center part includes acicular ferrite.

6. The structural steel of claim 5, wherein an average particle diameter of the acicular ferrite is 10 to 20 μm.

7. The structural steel of claim 1, wherein the steel further includes, by wt %, one or two or more of 0.02% or less of P, 0.01% or less of S, 0.005 to 0.10% of Nb, 0.001% or less of B, 0.005 to 0.1% of Ti, 0.0015 to 0.015% of N, 0.05 to 1.0% of Cr, 0.01 to 1.0% of Mo, 0.01 to 2.0% of Ni, 0.01 to 1.0% of Cu, 0.005 to 0.3% of V, and 0.006% or less of Ca.

8. The structural steel of claim 7, wherein the steel has 2% or greater of a Mn equivalent represented by $Mn_{eq}$ of Equation 1 below:

$$Mn_{eq}=[Mn]+1.5[Cr]+3[Mo]+[Si]/3+[Ni]/3+[Cu]/2+124[B] \quad \text{[Equation 1]}$$

wherein [Mn], [Cr], [Mo], [Si], [Ni], [Cu] and [B] refer to contents of Mn, Cr, Mo, Si, Ni, Cu, and B, respectively, and refer to 0 when the corresponding steel composition is not included.

9. The structural steel of claim 1, wherein a tensile strength of the steel is 570 MPa or greater.

10. A method for manufacturing the structural steel of claim 1, the method comprising:

reheating a slab including, by wt %, 0.02 to 0.12% of C, 0.01 to 0.8% of Si, 1.7 to 2.5% of Mn, 0.005 to 0.5% of Al, and the balance of Fe and inevitable impurities in a temperature range of 1050 to 1250° C.;

rough rolling the slab at a temperature of Tnr to 1150° C.;

first cooling the rough rolled steel to a temperature of Ms to Bs at a cooling rate of 5° C./s or higher, based on a temperature of the surface part of the rough rolled steel;

heat recuperating the steel by maintaining a surface part of the first-cooled steel to a temperature range of ($Ac_1$+40° C.) to ($Ac_3$−5° C.) by heat recuperation;

finish rolling the heat-recuperated steel; and second cooling the finish rolled steel to a temperature range of Ms to Bs° C. at a cooling rate of 5° C./s or higher; thereby producing the structural steel of claim 1.

11. The method of claim 10, wherein the slab further includes, by wt %, one or two or more of 0.02% or less of P, 0.01% or less of S, 0.005 to 0.10% of Nb, 0.001% or less of B, 0.005 to 0.1% of Ti, 0.0015 to 0.015% of N, 0.05 to 1.0% of Cr, 0.01 to 1.0% of Mo, 0.01 to 2.0% of Ni, 0.01 to 1.0% of Cu, 0.005 to 0.3% of V, and 0.006% or less of Ca.

12. The method of claim 10, wherein the slab has 2% or greater of an Mn equivalent represented by $Mn_{eq}$ of Equation 1 below:

$$Mn_{eq}=[Mn]+1.5[Cr]+3[Mo]+[Si]/3+[Ni]/3+[Cu]/2+124[B] \quad \text{[Equation 1]}$$

wherein [Mn], [Cr], [Mo], [Si], [Ni], [Cu] and [B] refer to contents of Mn, Cr, Mo, Si, Ni, Cu, and B, respectively, and refer to 0 when the corresponding steel composition is not included.

13. The method of claim 10, wherein the surface part is a region to a depth of 3 to 10% compared to a thickness of the steel from an outer surface of the steel toward a center of the steel.

14. The method of claim 10, wherein the first cooling is performed immediately after the rough rolling.

15. The method of claim 10, wherein a starting temperature of the first cooling is $Ae_3$+100° C. or lower with respect to a temperature of the surface part of the steel.

16. The method of claim 10, wherein a temperature of the finish rolling is Bs to Tnr° C.

* * * * *